US007175459B2

(12) United States Patent
Milner et al.

(10) Patent No.: US 7,175,459 B2
(45) Date of Patent: Feb. 13, 2007

(54) ELECTRICAL CONNECTOR HAVING A SPRING TO FACILITATE MOUNTING

(75) Inventors: John J. Milner, Madison, CT (US); Douglas P. O'Connor, Swansea, MA (US); Glenn T. Kierstead, Coventry, CT (US); Alan C. Miller, Madison, CT (US); Randolph R. Ruetsch, Branchburg, NJ (US); Shadi Abughazaleh, Glaes Ferry, CT (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 11/296,355

(22) Filed: Dec. 8, 2005

(65) Prior Publication Data

US 2006/0084312 A1 Apr. 20, 2006

Related U.S. Application Data

(62) Division of application No. 10/753,949, filed on Jan. 9, 2004, now Pat. No. 7,018,226.

(51) Int. Cl.
*H01R 13/52* (2006.01)

(52) U.S. Cl. ..... 439/271

(58) Field of Classification Search ..... 439/271, 439/321, 318–319, 311–312, 578–585, 314
See application file for complete search history.

(56) References Cited

U.S. PATENT DOCUMENTS 2,605,315 A 7/1952 Hargett
2,731,610 A 1/1956 Thacker
3,613,048 A 10/1971 Brundza
3,816,641 A 6/1974 Iversen
3,840,839 A 10/1974 Smaczny
3,963,297 A 6/1976 Panek
3,998,515 A 12/1976 Panek
4,361,374 A 11/1982 Marmillion
4,367,002 A 1/1983 Waghorn
4,447,103 A 5/1984 Werth
4,545,633 A 10/1985 McGeary
4,576,428 A 3/1986 DeLuca
4,681,383 A 7/1987 Hung
4,703,989 A 11/1987 Price
4,705,339 A 11/1987 Hayes
4,769,906 A 9/1988 Purpura
4,795,360 A 1/1989 Newman
4,917,617 A 4/1990 Smith
5,098,310 A * 3/1992 Avramovich et al. ..... 439/282
5,378,882 A 1/1995 Gong (Continued)

*Primary Examiner*—J. F Duverne
(74) *Attorney, Agent, or Firm*—Roylance, Abrams, Berdo & Goodman, LLP; Alfred N. Goodman

(57) ABSTRACT

An electrical connector is provided that protects the electrical connector and associated components from harsh mechanical, electrical and environmental requirements. A jack is received by a jack housing, and a plug is received by a plug housing. The jack is adapted to receive the plug. A first seal member is positioned between the plug housing and the jack housing to form a seal therebetween when the jack and the plug are connected. A coupling member is attached to the plug housing and is adapted to receive the jack housing. A spring member is positioned between the coupling member and the plug housing to compress the first seal member between the jack housing and the plug housing.

20 Claims, 6 Drawing Sheets

U.S. PATENT DOCUMENTS

| | | | |
|---|---|---|---|
| 5,484,301 | A | 1/1996 | Koumatsu |
| 5,485,673 | A | 1/1996 | Lau |
| 5,564,951 | A | 10/1996 | Attal |
| 5,595,504 | A | 1/1997 | Muller |
| 5,618,204 | A | 4/1997 | Nix |
| 5,683,263 | A | 11/1997 | Hsu |
| 5,803,770 | A | 9/1998 | Swendson |
| 5,823,811 | A | 10/1998 | Blanchfield |
| 5,906,513 | A | 5/1999 | Peterson |
| 6,171,136 | B1 | 1/2001 | Liu |
| 6,409,532 | B2 | 6/2002 | Payson |
| 6,435,911 | B1 | 8/2002 | Payson |
| 6,475,009 | B2 | 11/2002 | Below |
| 6,595,791 | B2 | 7/2003 | Below |
| 6,692,285 | B2 * | 2/2004 | Islam ..... 439/352 |

* cited by examiner

ELECTRICAL CONNECTOR HAVING A SPRING TO FACILITATE MOUNTING

REFERENCE TO PRIOR NONPROVISIONAL APPLICATION

This application is a divisional application of U.S. patent application Ser. No. 10/753,949, filed Jan. 9, 2004, now U.S. Pat No. 7,018,226 which is hereby incorporated by reference in its entirety.

FIELD OF THE INVENTION

The present invention relates to an electrical connector that protects it internal components from harsh mechanical, electrical and environmental requirements. More particularly, the present invention relates to a harsh environment electrical connector having a spring member to facilitate compression of a seal member with a mounting surface to seal the electrical connector. Still more particularly, the present invention relates to a harsh environment electrical connector having a plug assembly and a housing assembly that are mated together and secured to a mounting surface. The plug assembly has a spring member to facilitate compression of seal members in the plug and jack assemblies to seal the electrical connector to withstand harsh mechanical, electrical and environmental conditions.

BACKGROUND OF THE INVENTION

Telecommunication systems continue to be used in new environments because of the increasing necessity for fast and efficient data access and transfer. Many of those environments subject the telecommunication systems to harsh conditions, such as exposure to water, dust, temperature changes and other foreign materials. Electrical connectors used in these telecommunication systems need to be able to protect the electrical connections from these harsh conditions. Invasion of an electrical connector by foreign matter can destroy the integrity of the electrical connection, thereby rendering the electrical connector and the telecommunication system inoperable. Such an event causes time delays and increased costs in the application in which the electrical connector is being used. Thus, a need exists for an electrical connector that prevents foreign materials from invading the electrical connector and associated components.

Industrial and manufacturing environments commonly use telecommunication systems to increase efficiency. Electrical connectors in such environments are frequently exposed to large amounts of foreign materials that are prevalent in those environments. Dust, water, chemicals and other foreign materials are much more difficult to contain and exist in larger quantities in those environments than in office environments. Therefore, industrial and manufacturing environments require electrical connectors to withstand frequent and large quantities of foreign materials. Furthermore, in industrial and manufacturing applications failure of the telecommunication system due to a damaged electrical connector may result in temporary downtimes, thereby resulting in inefficient industrial and manufacturing applications. Therefore, a need exists for an electrical connector that is protected from the large quantities of potentially damaging foreign materials that are prevalent in certain environments.

SUMMARY OF THE INVENTION

Accordingly, it is a primary objective of the present invention to provide an improved electrical connector.

A further objective of the present invention is to provide an improved electrical connector for use in telecommunication systems.

A further objective of the present invention is to provide an improved electrical connector that protects the electrical connector and associated components from harsh mechanical, electrical and environmental requirements.

Another objective of the present invention is to provide an improved electrical connector that protects the electrical connector and associated components from the large quantities of foreign materials that are prevalent in particular environments in which the electrical connector is used.

A still further objective of the present invention is to provide an electrical connector having a spring member that facilitates mounting and sealing the electrical connector with a surface.

The foregoing objects are basically attained by providing an electrical connector that protects the electrical connector and associated components from harsh mechanical, electrical and environmental requirements. A jack is received by a jack housing and a plug is received by a plug housing. The jack is matable with the plug. A first seal member is positioned between the plug housing and the jack housing to form a seal therebetween. A coupling member is attached to the plug housing and receives the jack housing. A spring member is positioned between the coupling member and the plug housing to provide a biasing force between the jack housing and the plug housing to compress the first seal member. The compression of the first seal member by the spring member increases the efficiency of the seal, thereby protecting the electrical connector and its internal components from harsh mechanical, electrical and environmental requirements.

Other objects, advantages and salient features of the invention will become apparent from the following detailed description, which, taken in conjunction with the annexed drawings, discloses a preferred embodiment of this invention.

BRIEF DESCRIPTION OF THE DRAWINGS

Referring now to the drawings that form a part of the original disclosure.

DETAILED DESCRIPTION OF THE INVENTION

Figure 1:
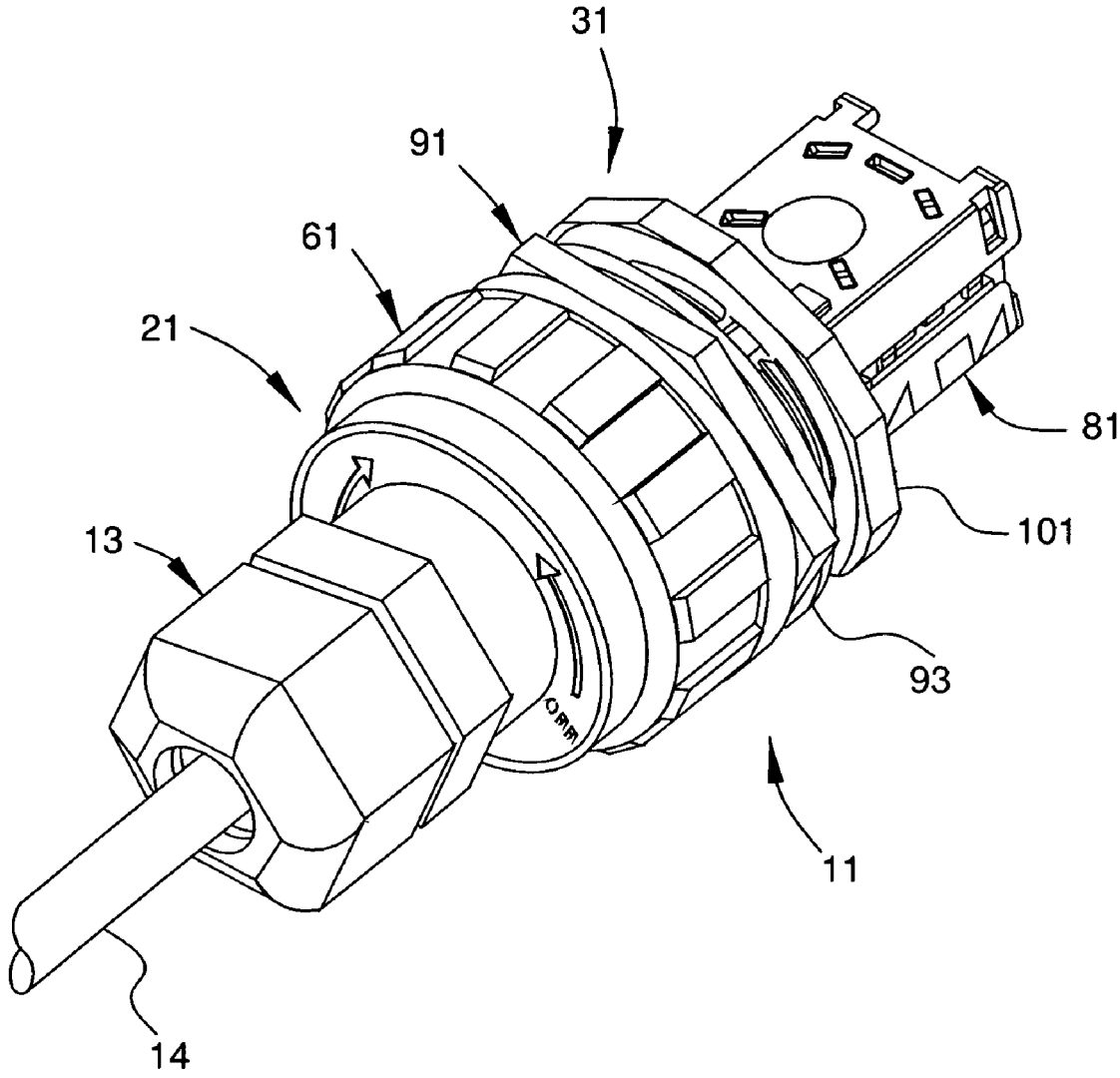
FIG. 1 is a perspective view of an electrical connector according to the present invention.

As shown in FIGS. 1–11, the present invention relates to an electrical connector 11 that protects the connector and its associated internal components from harsh mechanical, electrical and environmental requirements. A jack 81 is received by a jack housing 91 and a plug 41 is received by a plug housing 51. The jack 81 is adapted to receive and receives the plug 41. A first seal member 111 is positioned between the plug housing 51 and the jack housing 91 to form a seal therebetween when the jack 81 and the plug 41 are connected. A coupling member 61 is attached to the plug housing 51 and is adapted to receive the jack housing 91. A spring member 71 is positioned between the coupling member 61 and the plug housing 51 to facilitate compression of the first seal member 111 between the jack housing 91 and the plug housing.

Figure 4:
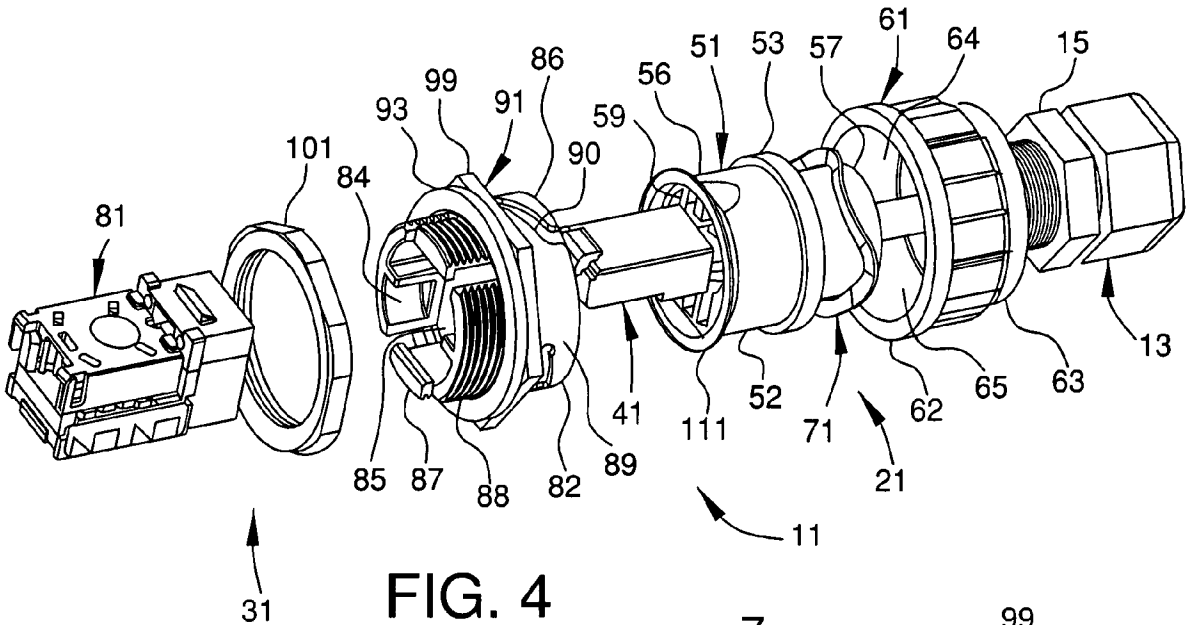
FIG. 4 is an exploded perspective view of the electrical connector of FIG. 1.
Figure 5:
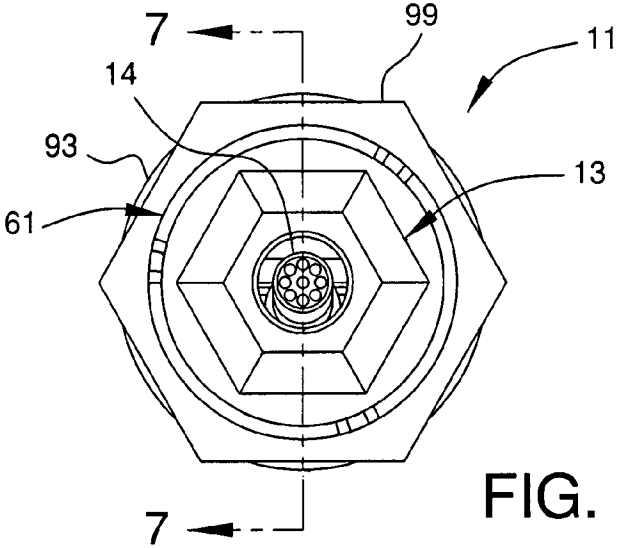
FIG. 5 is a front elevational view of the electrical connector of FIG. 1.

The electrical connector 11 of the present invention has a plug assembly 21 that is adapted to receive a plug 41 and a jack assembly 31 that is adapted to receive a jack 81, as shown in FIGS. 1 and 4. A cord connector assembly 13 secures a cable 14 to the plug assembly 21 of the electrical connector 11. The cable 14 is connected to the plug 41.

Figure 7:
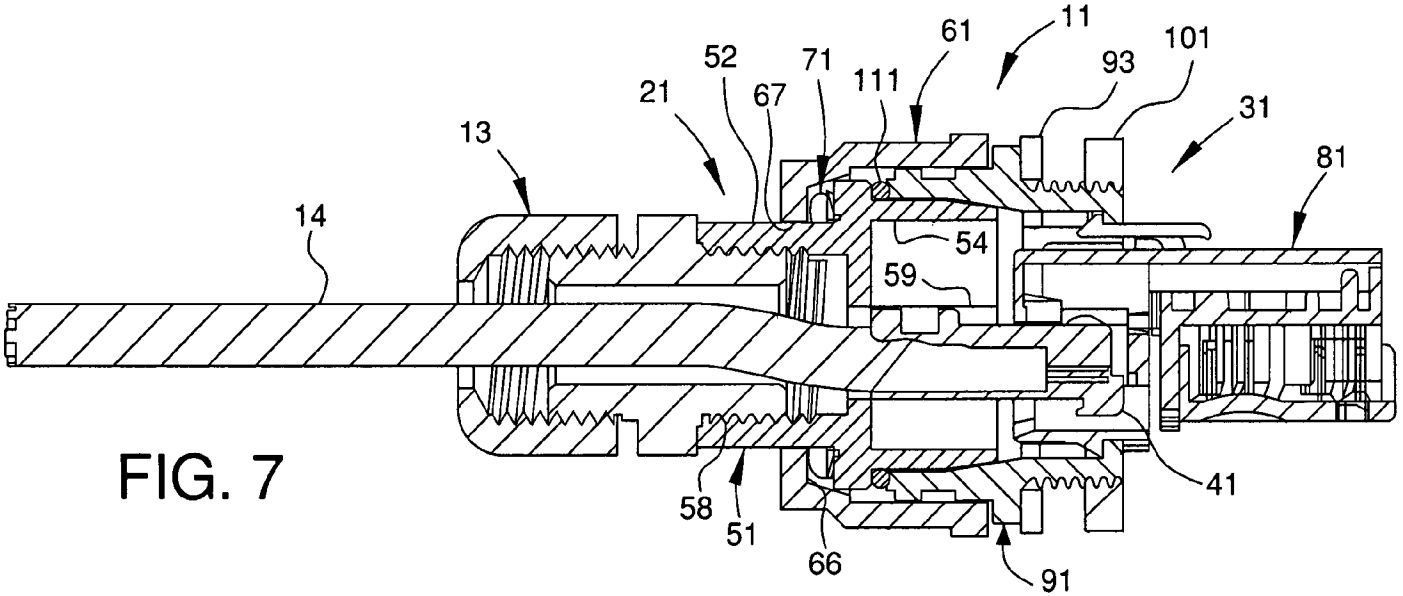
FIG. 7 is side elevational view in cross section of the electrical connector of FIG. 6 taken along line 7—7 of FIG. 5.

The plug assembly 21 includes the plug 41 that is received in a plug housing 51, as shown in FIGS. 4 and 7. The plug housing 51 has an outer surface 52 and an inner surface 54. A first passageway 55 extends from a front end 56 of the plug housing 51 to the rear end 57 to form the inner surface 54. The rear portion 58 of the inner surface 54 is threaded to receive the cord connector assembly 13. The front portion 59 of the inner surface 54 is adapted to securely receive the plug 41, as shown in FIG. 7. Once the plug 41 is received by the plug housing 51, the cord connector assembly 13 threads into the threaded inner surface of the rear portion 58 of the plug housing to securely retain the plug within the plug housing. A first shoulder 53 extends outwardly from the outer surface 52 of the plug housing 51 between the front and rear ends 56 and 57.

A coupling member 61 has a front end 62 and a rear end 63. A second passageway 64 extends from the front end 62 to the rear end 63 to form an inner surface 65 of the coupling member 61. Inner rear wall 66 of the coupling member 61 has an opening 67 therethrough to slide over the cord connector assembly 13 and onto the plug housing 51. A first shoulder 53 on the plug housing 51 has a larger diameter than the opening 67 to prevent further forward movement of the coupling member 61.

Figure 10:
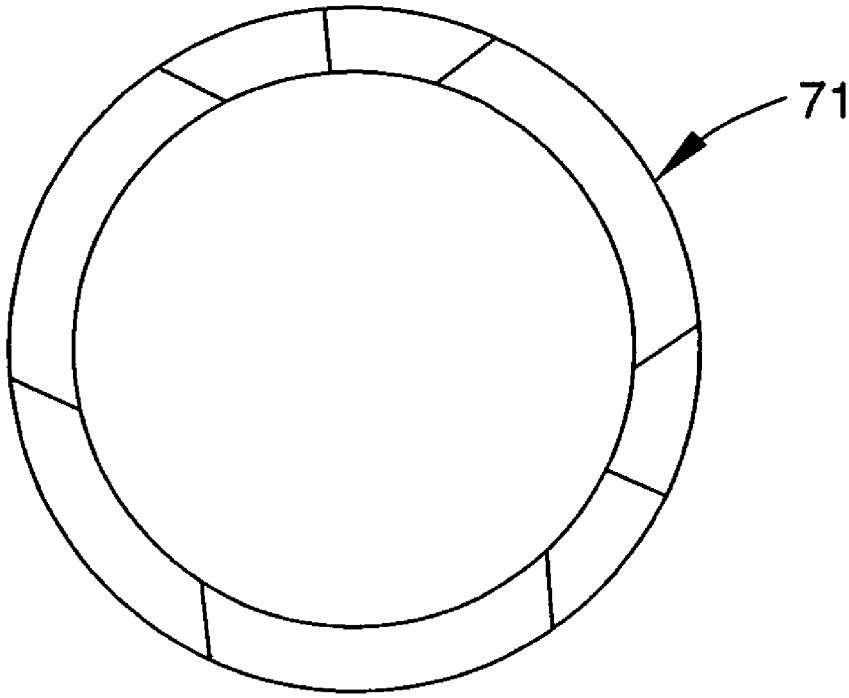
FIG. 10 is a top plan view of the spring of the electrical connector.
Figure 11:
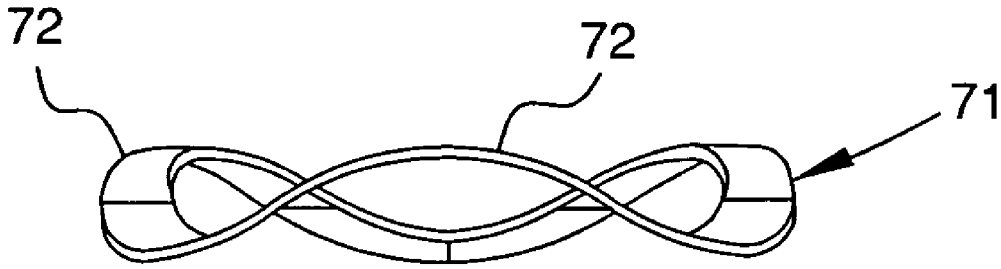
FIG. 11 is a front elevational view of the spring of FIG. 10.

A spring 71 is disposed on the outer surface 52 of the plug housing 51 rearward of the first shoulder 53 between the first shoulder and the coupler nut 61, as shown in FIGS. 4 and 7. Preferably, the spring 71 is stainless steel. As shown in FIG. 10, the spring 71 is circular in a top plan view. As shown in FIG. 11, the spring 71 is an overlap type having a number of bends 72. Overlap type springs provide equal deflection within a smaller spring cavity.

A first seal member 111 is disposed on the outer surface 52 of the plug housing 51 forward of the shoulder 53, as shown in FIGS. 4 and 7. Preferably, the first seal member 111 is an O-ring.

The jack assembly 31 includes the jack 81 and jack housing (coupler body) 91, as shown in FIGS. 1, 4 and 7. The jack housing 81 has an outer surface 82 and an inner surface 84. A third passageway 85 extends from a front end 86 of the jack housing 81 to the rear end 87 to form the inner surface 84. The inner surface 84 of the jack housing 81 is adapted to securely receive the jack 81, as shown in FIG. 4. The rear portion 88 of the outer surface 82 is threaded to receive a fastener 101 to secure the jack housing 91 to a mounting surface 12. A second shoulder 99 extends outwardly from the jack housing 91 to prevent further movement of the jack housing through an opening in the mounting surface 12 through which the jack housing is inserted. The front portion 89 of the outer surface 82 is adapted to securely receive the coupling member 61, as shown in FIG. 7. Preferably, the front portion 89 of the jack housing 81 has grooves 90 that receive protrusions (not shown, but similar to tabs) on the coupling member to secure the coupling member 61 to the jack housing through a bayonet connection.

Figure 2:
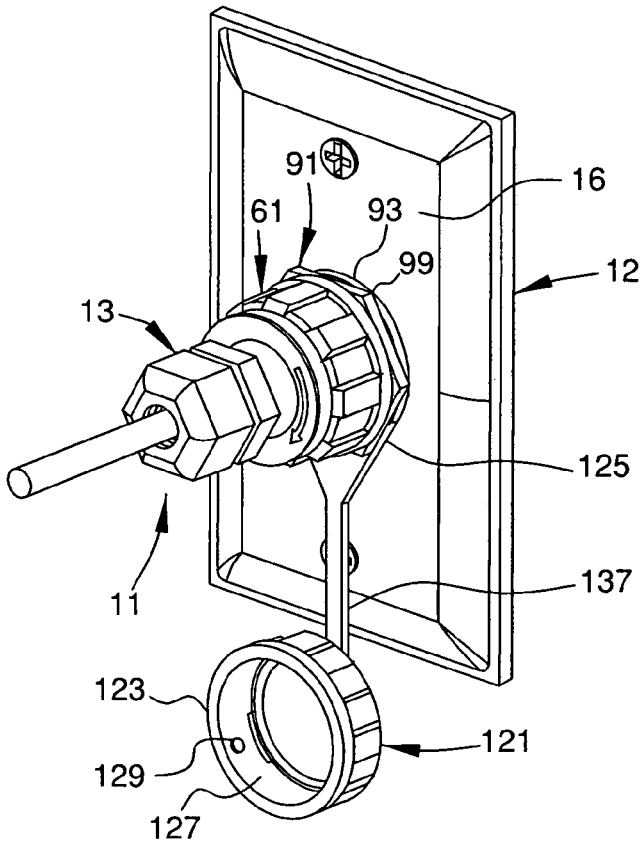
FIG. 2 is a perspective view of the electrical connector of the present invention secured to a support and having an attached cap.

A second seal member 93 is disposed on the outer surface 82 of the jack housing rearward of the second shoulder 99. Preferably, the second seal member is a gasket. The second seal member 93 is positioned between the second shoulder 99 of the jack housing 91 and the mounting surface 12 to which the electrical connector 11 is mounted, as shown in FIGS. 2 and 3.

Figure 3:
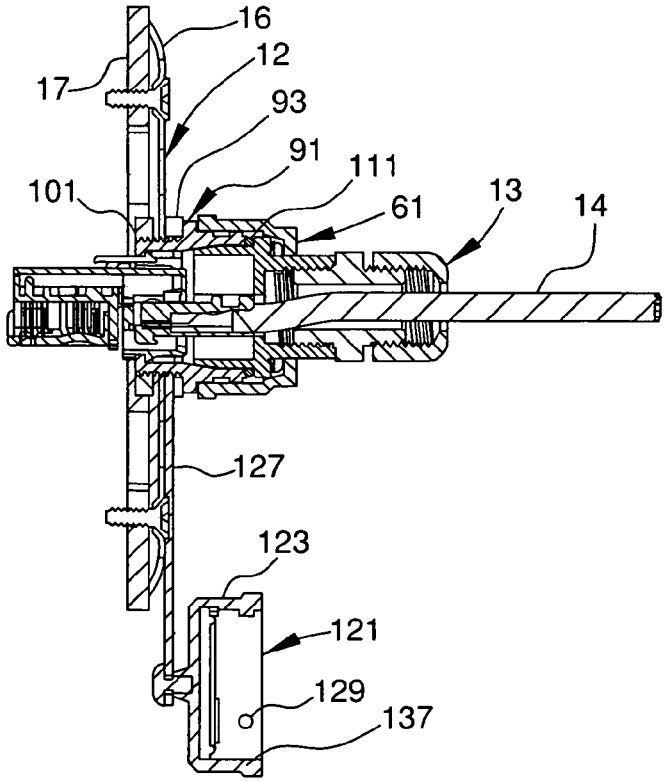
FIG. 3 is a side elevational view in cross section of the electrical connector of FIG. 2.

A fastener 101 threads onto the jack housing 91 to secure the electrical connector 11 to a mounting surface 12, as shown in FIG. 3. Preferably, the fastener 101 is a hex nut, as shown in FIG. 4. The fastener 101 threads onto the rear portion 88 of the outer surface 82 of the jack housing 91.

A second seal member 93 is provided between the jack housing 91 and the mounting surface 12 to provide a watertight connection between the electrical connector 11 and the mounting surface. Preferably, the second seal member 93 is an O-ring. The second seal member 93 is disposed on the rear portion 88 of the outer surface 82 of the jack housing 91 rearward of second shoulder 99.

Figure 6:
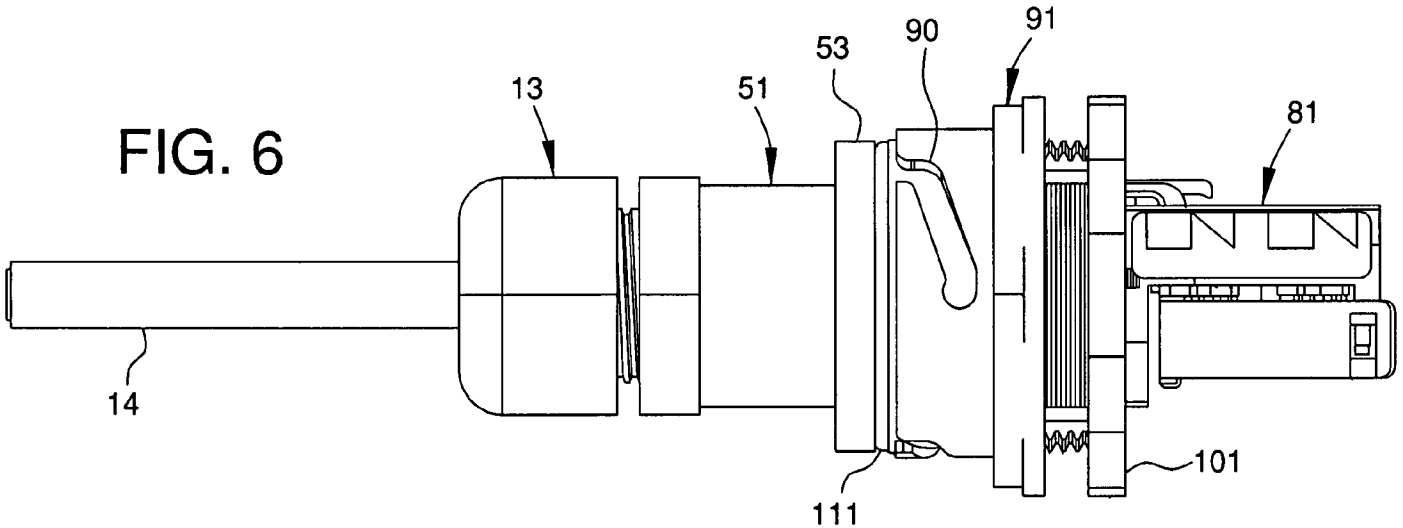
FIG. 6 is a side elevational view of the electrical connector of FIG. 1

Cord connector assembly 13 threads into the plug housing 51, as shown in FIGS. 4, 6 and 7. The cord connector assembly mates to the plug housing and seals the patch cord 14, as well as providing strain relief for the patch cord cable. Fastener 15 threads into the threaded inner surface of the rear portion 58 of the plug housing 51. Cord connector assemblies are readily available, such as the PG9 cord connector.

A cap assembly 121 may also be secured to the connector assembly 11, as shown in FIGS. 2 and 3. The cap assembly 121 includes a cap 123 and a connecting member, or tether, 127. The connecting member 127 may be connected to the second seal member 93. Alternatively, a connecting seal member 125 having an integral tether 127 may be used in lieu of or in addition to the second seal member 93. The connecting member 127 connects the cap 123 to either the second seal member 93 or the integral connecting seal member 125. The connecting seal member 125 maybe disposed on the rear portion 88 of the outer surface 82 of the jack housing rearward of the second shoulder 99. An inner surface 137 of the cap 121 has tabs 129 that mate with the grooves 90 of the jack housing 91 when the coupling member 61 has been removed from the jack housing, thereby protecting the jack 81. The connecting seal member 125 seals the connection between the jack housing 91 and the mounting surface 12.

Assembly and Disassembly

Figure 8:
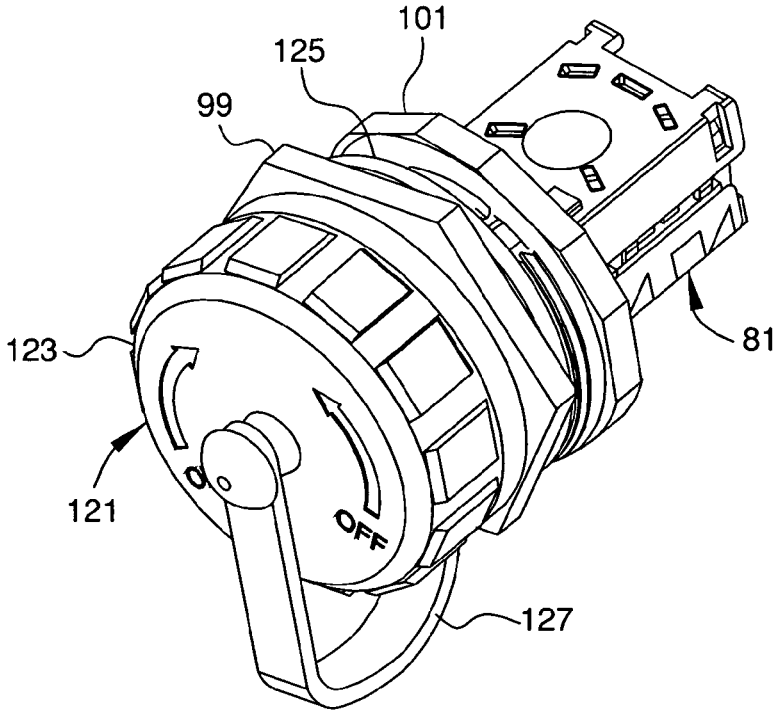
FIG. 8 is a perspective view of the electrical connector of FIG. 2 with the cap attached.
Figure 9:
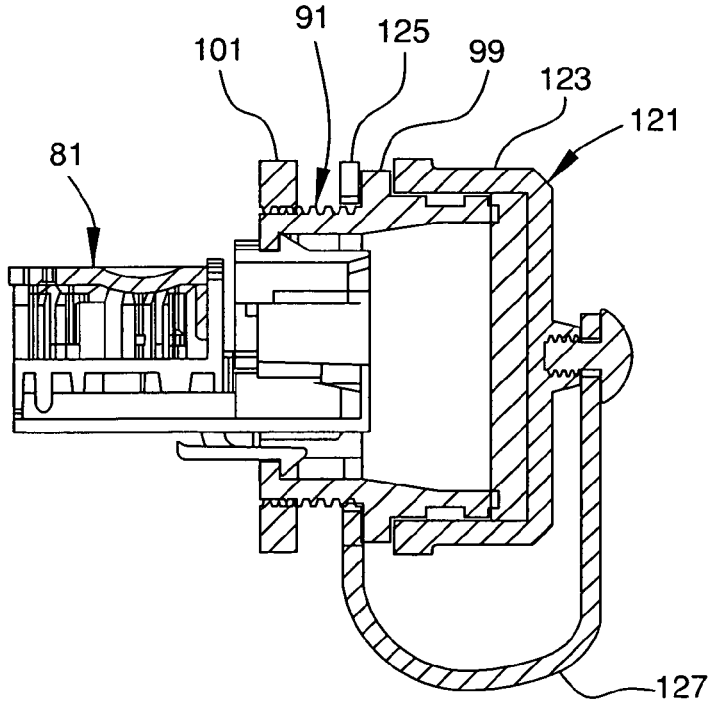
FIG. 9 is an elevational view in cross section of the electrical connector and cap of FIG. 8.

An exploded view of the electrical connector 11 of the present invention is shown in FIG. 4. As shown in FIGS. 1, 6 and 7, the electrical connector 11 of the present invention is fully assembled. As shown in FIGS. 2 and 3, the electrical connector 11 with cap assembly 121 is fully constructed and mounted to a mounting surface 12. As shown in FIGS. 8 and 9, the plug assembly 21 has been removed and replace with a cap assembly 121 to protect the jack assembly 31 until the plug assembly is installed.

A cable 14, or any other suitable structure capable of data transfer, is connected to the cord connector assembly 13. A free end of the cable 14 is connected to the plug 41, which is preferably an RJ-45 plug without a latch member. The plug 41 is inserted into the first passageway 55 in the front portion 59 of the inner surface 54 of the plug housing, where the plug is securely received, as shown in FIG. 7. Once the plug 41 has been inserted in the plug housing 51, the first seal member 111 is disposed on the outer surface 52 forward of the first shoulder 53 and the spring 71 is disposed on the outer surface rearward of the first shoulder. The coupling member 61 is then slid over the plug housing 51. The cord connector assembly 13 is then threaded into the rear portion 58 of the plug housing 51. The fastener 15 of the cord connector assembly 13 is threaded into the plug housing 51 until it abuts the rear end 57 of the plug housing. The cord connector assembly 13 secures the plug 41 within the plug housing 51. The coupling member 61 is then slid over the plug housing 51 until the rear wall 66 of the coupling member abuts the spring 71.

The jack 81, preferably an RJ-45 jack, is inserted into the inner surface 84 of the jack housing 91, which is adapted to securely receive the jack, as shown in FIGS. 7 and 9. The second seal member 93 is disposed on the outer surface 82 of the jack housing rearward of the second shoulder 99. If desired, the connecting member 125 of the cap assembly 121 may be disposed on the rear portion 88 of the outer surface 82 of the jack housing 91 rearward of the second shoulder 99 in lieu of or in addition to the second seal member 93.

The jack assembly 31 is then inserted through an opening in a mounting surface 12 from a first side 16, as shown in FIG. 2. The second seal member 93 abuts the first side 16 of the mounting surface 12. The fastener 101 is then threaded onto the outer surface 82 of the rear portion 88 of the jack housing 91 until it abuts the second side 17 of the mounting surface, thereby securely fastening the jack housing 91 to the mounting surface.

The plug housing 51 is then inserted into the jack housing 91 so that the jack and plug are mated. The first seal member 111 is then positioned between the first shoulder 53 of the plug housing 51 and the front end 86 of the jack housing 91, thereby effectively sealing the plug housing and jack housing together.

The coupling member 61 is then slid forward over the plug housing 51 until the rear wall 66 of the coupling member is proximal the first shoulder. As the coupling member is mated with the jack housing, preferably by a bayonet connection, the rear wall 66 of the coupling member compresses the spring 71 against the first shoulder 53 of the plug housing 51. This force moves the plug housing 51 forward toward the first side 16 of the mounting surface 12, which facilitates compression of both the first and second seal members 111 and 93, thereby increasing their sealing efficiency.

The plug assembly 21 may be removed at any time and replaced with a cap assembly, as shown in FIGS. 8 and 9. The cap 123 has tabs 129 that engage the grooves 90 of the jack housing 91 to mate the cap assembly 121 with the jack housing. The cap assembly may be removed at any time and replaced with the plug assembly 21 as described above.

While one advantageous embodiment has been chosen to illustrate the invention, it will be understood by those skilled in the art that various changes and modifications may be made therein without departing from the scope of the invention as defined in the appended claims.

What is claimed is:

1. An electrical connector, comprising:
a jack;
a jack housing receiving said jack;
a plug matable with said jack;
a plug housing receiving said plug;
a first seal member positioned between said plug housing and said jack housing to form a seal therebetween;
a coupling member attached to said plug housing and directly connected to said jack housing; and
a spring member positioned between said coupling member and said plug housing providing a biasing force between said jack housing and said plug housing to compress said first seal member.

2. An electrical connector according to claim 1, wherein said jack is an RJ-45 jack and said plug is an RJ-45 plug.

3. An electrical connector according to claim 1, wherein a fastening member is threadably received by said jack housing to mount said electrical connector to a surface.

4. An electrical connector according to claim 3, wherein said fastening member is a nut.

5. An electrical connector according to claim 3, wherein a second seal member is disposed on said plug housing between said fastening member and a second shoulder.

6. An electrical connector according to claim 1, wherein said plug housing has a first shoulder on an external surface to limit movement of a rear wall of said coupling member.

7. An electrical connector according to claim 6, wherein said spring is disposed on said plug housing between said first shoulder and said rear wall of said coupling member.

8. An electrical connector according to claim 1, wherein said spring is an overlap spring.

9. An electrical connector according to claim 1, wherein said spring is made of stainless steel.

10. An electrical connector according to claim 1, wherein a cap is connected to said jack housing.

11. An electrical connector according to claim 10, wherein said cap is coupled to said jack housing for closing said jack housing when said coupling member is removed.

12. An electrical connector, comprising:
a jack;
a jack housing receiving said jack;
a plug matable with said jack;
a plug housing receiving said plug;
a first seal member positioned between said plug housing and said jack housing to form a seal therebetween;
a coupling member attached to said plug housing and receiving said jack housing;
a spring member positioned between said coupling member and said plug housing providing a biasing force between said jack housing and said plug housing to compress said first seal member; and
a cap connected to said jack housing, said cap being coupled to said jack housing to close said jack housing when said coupling member is removed.

13. An electrical connector according to claim 12, wherein said jack is an RJ-45 jack and said plug is an RJ-45 plug.

14. An electrical connector according to claim 12, wherein a fastening member is threadably received by said jack housing to mount said electrical connector to a surface.

15. An electrical connector according to claim 14, wherein said fastening member is a nut.

16. An electrical connector according to claim 14, wherein a second seal member is disposed on said plug housing between said fastening member and a second shoulder.

17. An electrical connector according to claim 12, wherein said plug housing has a first shoulder on an external surface to limit movement of a rear wall of said coupling member.

18. An electrical connector according to claim 17, wherein said spring is disposed on said plug housing between said first shoulder and said rear wall of said coupling member.

19. An electrical connector according to claim 12, wherein said spring is an overlap spring.

20. An electrical connector according to claim 12, wherein said spring is made of stainless steel.

* * * * *